US006970671B2

(12) United States Patent
Ikeda et al.

(10) Patent No.: US 6,970,671 B2
(45) Date of Patent: Nov. 29, 2005

(54) IMAGE FORMING APPARATUS

(75) Inventors: Taro Ikeda, Chiba (JP); Hiroyuki Sekine, Aichi (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 10/687,815

(22) Filed: Oct. 20, 2003

(65) Prior Publication Data

US 2004/0131388 A1 Jul. 8, 2004

(30) Foreign Application Priority Data

Oct. 31, 2002 (JP) ..... 2002-317297

(51) Int. Cl.[7] ..... G03G 15/08

(52) U.S. Cl. ..... 399/227; 399/119; 399/226; 399/228; 399/265; 399/269; 399/294; 399/286

(58) Field of Search ..... 399/119, 265, 294, 399/286, 228, 226, 227, 269

(56) References Cited

U.S. PATENT DOCUMENTS 5,160,969 A * 11/1992 Mizuma et al. ..... 399/223
5,258,819 A * 11/1993 Kimura et al. ..... 399/119

FOREIGN PATENT DOCUMENTS

JP 11-002961 * 12/1997 ..... G03G 15/08
JP 2000-147900 5/2000

* cited by examiner

*Primary Examiner*—Arthur T. Grimley
*Assistant Examiner*—Peter Lee
(74) *Attorney, Agent, or Firm*—Fitzpatrick, Cella, Harper & Scinto

(57) ABSTRACT

An image forming apparatus has a plurality of developing devices for developing an electrostatic image formed on an image bearing member, and a rotary member holding the plurality of developing devices and rotated in a route including a developing position, the rotary member selectively positioning any one of the developing devices at the developing position. Each of the plurality of developing devices has a plurality of developer carrying members carrying a developer thereon and carrying the developer to the image bearing member.

4 Claims, 4 Drawing Sheets

IMAGE FORMING APPARATUS

BACKGROUND OF THE INVENTION

1. Field of the Invention

The invention relates to an image forming apparatus adopting an electrophotographic process or an electrostatic recording process, and particularly to an image forming apparatus such as a copying machine, a printer or a facsimile apparatus.

2. Description of Related Art

In an image forming portion in an image forming apparatus such as a copying machine, a photosensitive member which is an image bearing member is charged by a charging apparatus, and is exposed to the image of an original at an exposure position by an exposing optical system to thereby form an electrostatic latent image on the peripheral surface of the photosensitive member, and this electrostatic latent image is developed by a developing apparatus to thereby form a developer image (toner image), and this toner image is transferred to a transferring material by the application of a voltage by a transferring apparatus, and the photosensitive member after the transfer is cleaned by a cleaning apparatus, whereafter exposure before charging is effected to thereby remove any residual charges on the photosensitive member, and the above-described process is repeated again to thereby effect image forming.

There has also been proposed an image forming apparatus which is provided with a plurality of photosensitive members, charging apparatuses and developing apparatuses and repeats the above-described image forming process a plurality of times to thereby form a full-color image.

Further, in the above-described image forming apparatus for forming a full-color image, it has heretofore been proposed to provide a plurality of developer carrying members (hereinafter referred to as the developing sleeves) in the developing apparatuses.

In this case, the developing sleeves are disposed with a predetermined clearance relative to the photosensitive members, but it is possible to form images of high definition at a high speed without greatly increasing the peripheral speed of the developing sleeves.

Also, in the black-and-white image forming apparatus of Japanese Patent Application Laid-Open No. 2000-147900 which has a developing device provided with a plurality of developing sleeves and fixedly disposed around a photosensitive member, there is proposed a method of pressing one developing sleeve against the photosensitive member with the other developing sleeve as a fulcrum.

The above-described full-color image forming apparatus, however, tends to become bulky and has posed a problem in this point. That is, neither of the higher speed and higher quality of image and the downsizing of the image forming apparatus could be made compatible.

SUMMARY OF THE INVENTION

It is an object of the present invention to provide an image forming apparatus which can make both of the higher speed of image forming and the downsizing of the image forming apparatus compatible.

It is another object of the present invention to provide an image forming apparatus which can make both of a higher quality of image in image forming and the downsizing of the image forming apparatus compatible.

It is another object of the present invention to provide an image forming apparatus in which a plurality of developer carrying members can be accurately positioned relative to an image bearing member by a simple construction.

Further objects of the present invention will become apparent from the following detailed description when read with reference to the accompanying drawings.

DESCRIPTION OF THE PREFERRED EMBODIMENTS

Some embodiments of the present invention will hereinafter be described with reference to the drawings.

Figure 1:
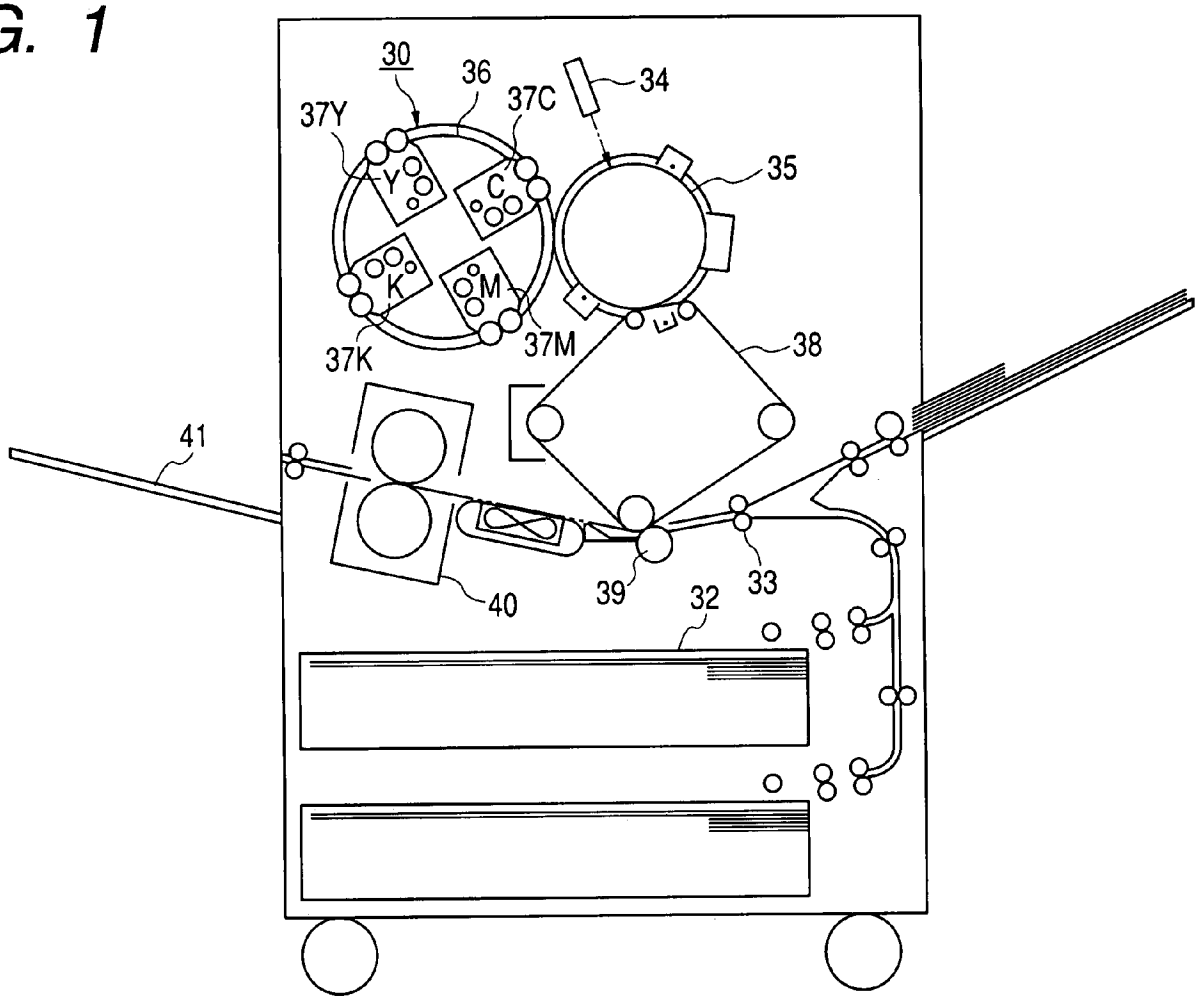
FIG. 1 is a schematic cross-sectional view of a full-color copying apparatus provided with a developing apparatus according to the present invention.

FIG. 1 is a schematic cross-sectional view of a full-color printer provided with a developing apparatus according to the present invention.

In the full-color printer of FIG. 1, the image information of an original read by an image reading portion (not shown) is processed by an image processing portion (not shown). For example, a recording sheet (not shown) fed from a cassette sheet feeding portion 32 has its skew feeding corrected at a registering portion 33 and comes to a secondary transferring portion 39.

On the other hand, the image data processed by the image processing portion (not shown) is recorded as a latent image on a photosensitive drum 35 by a laser scanner portion 34. When a full-color image is to be formed, the latent image is developed by a rotary type developing apparatus 30. Here, the rotary type developing apparatus 30 develops the latent image on the photosensitive drum 35 as toner images of four colors while changing over a plurality of (four) developing devices 37K (black), 37C (cyan), 37M (magenta) and 37Y (yellow) to a rotary containing portion 36. The toner images of four colors are superimposed and primary-transferred onto an intermediate transferring belt 38, and the toner images on the intermediate transferring belt 38 are collectively transferred to the recording sheet at the secondary transferring portion 39. The toner image on the recording sheet is fixed on the recording sheet by a fixing portion 40, and the recording sheet having the toner image thereon fixed is discharged to a sheet discharging portion 41.

Description will now be made of the action of the rotary type developing apparatus according to the present invention.

First, as a premise, when the rotary type developing apparatus 30 provided with two developing sleeves is used, both of the higher speed (or higher quality of image) of image forming and downsizing can be made compatible.

FIGS. 2 to 5 show the developing operation of the rotary type developing apparatus 30 provided with two developing sleeves. While for simplicity, a developing device 37 alone is taken as an example and the action thereof will hereinafter be described, the other developing devices are also similar in construction.

Also, the electrostatic image formed on the photosensitive drum 35 is adapted to be developed by a developing sleeve S1 and a developing sleeve S2 which will be described later, in the named order.

Figure 2:
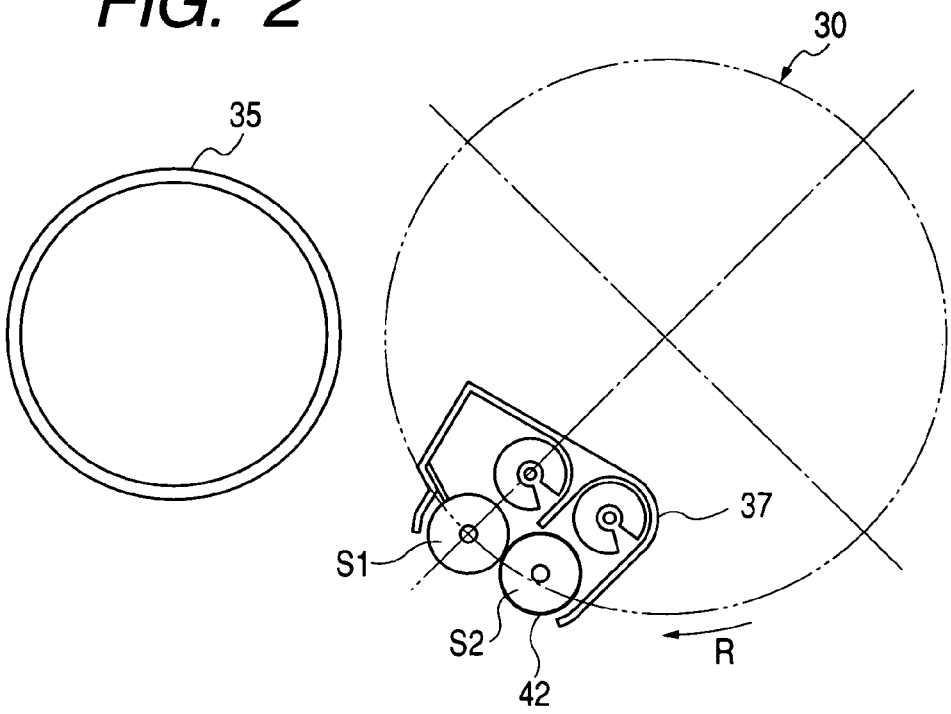
FIG. 2 is a cross-sectional view illustrating the developing operation of the developing apparatus according to the present invention.

Referring to FIG. 2, a regulating member 42 for ensuring a gap (hereinafter referred to as the SD gap) with respect to the photosensitive drum 35 is mounted on the developing sleeve S2 outside a developing area, often on the opposite end portions thereof.

Figure 3:
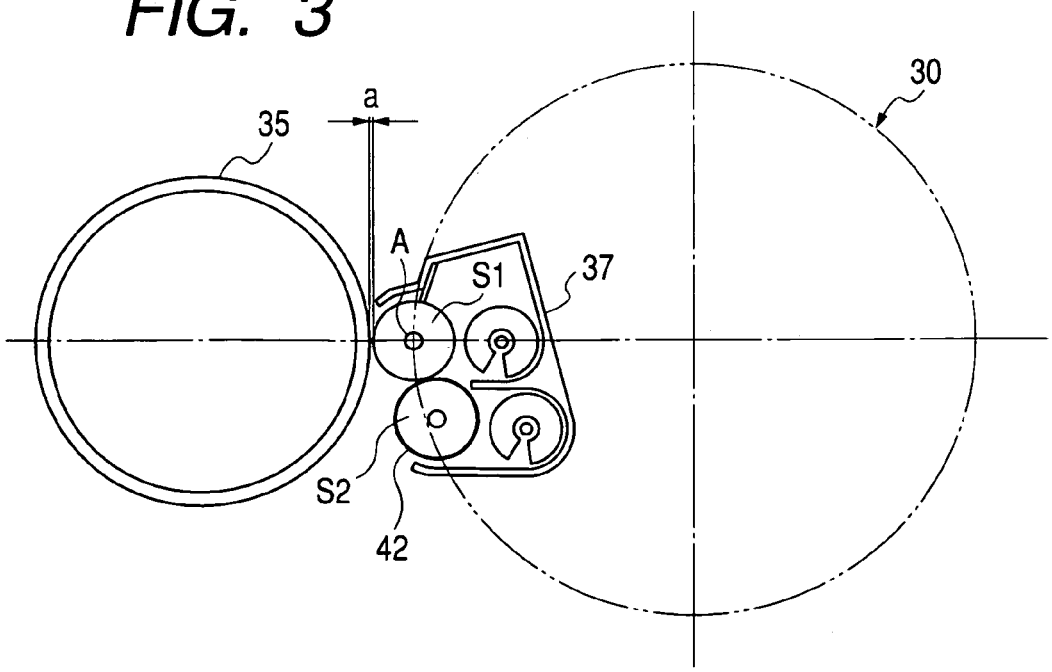
FIG. 3 is a cross-sectional view illustrating the developing operation of the developing apparatus according to the present invention.

FIG. 2 shows the retracted positions of the developing sleeves S1 and S2 in the developing device 37 being rotated, and the developing sleeve S2 on the downstream side with respect to the direction of rotation (the direction indicated by the arrow R) of the developing device 37 is retracted to a position in which it does not interfere with the photosensitive drum 37 when the rotary type developing apparatus 30 is being rotated. When the developing sleeve S1 on the upstream side comes to a developing position, the rotation of the rotary type developing apparatus 30 is stopped. At this time, as shown in FIG. 3, the photosensitive drum 35 and the developing sleeve S1 are adjusted so that the gap between the two may be a, and this also holds true of the other developing devices.

Figure 4:
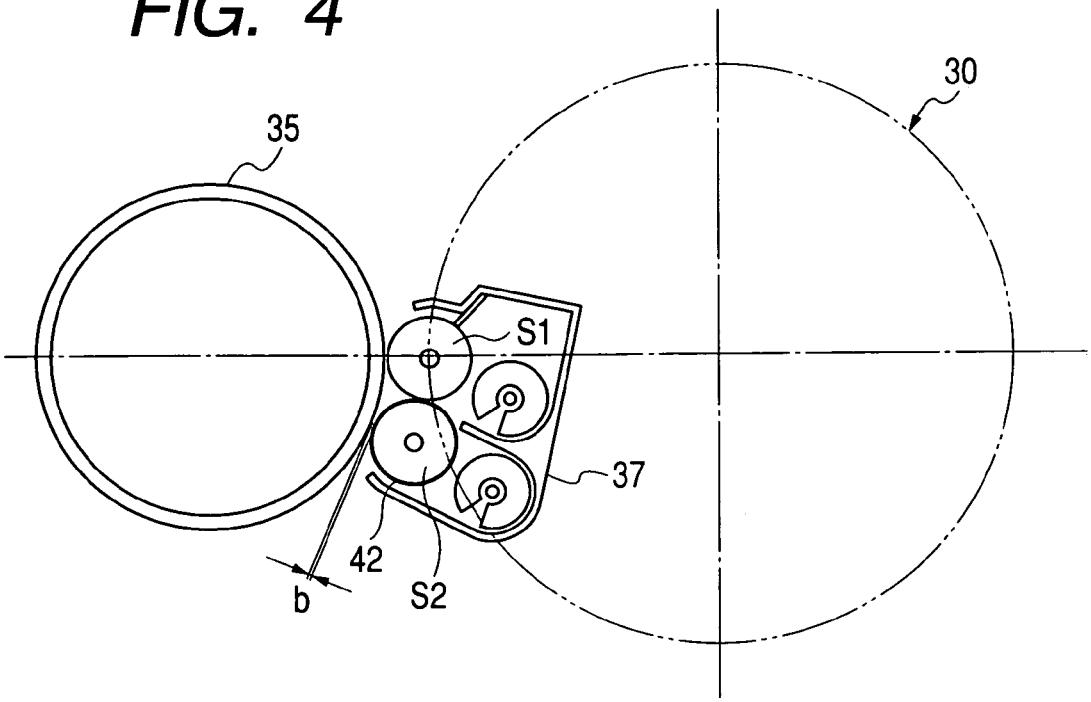
FIG. 4 is a cross-sectional view illustrating the developing operation of the developing apparatus according to the present invention.

When in the above-described state, predetermined developing is effected by the developing sleeve S1, the developing device 37 is rotated about the center of rotation A of the developing sleeve S1 by driving means (not shown) to a position in which the regulating member 42 for ensuring the gap between the photosensitive drum 35 and the developing sleeve S2 contacts with the photosensitive drum 35, as shown in FIG. 4. Thereupon, the gap between the photosensitive drum 35 and the developing sleeve S2 is kept at a predetermined value "b", and predetermined developing is effected by the developing sleeve S2.

Figure 5:
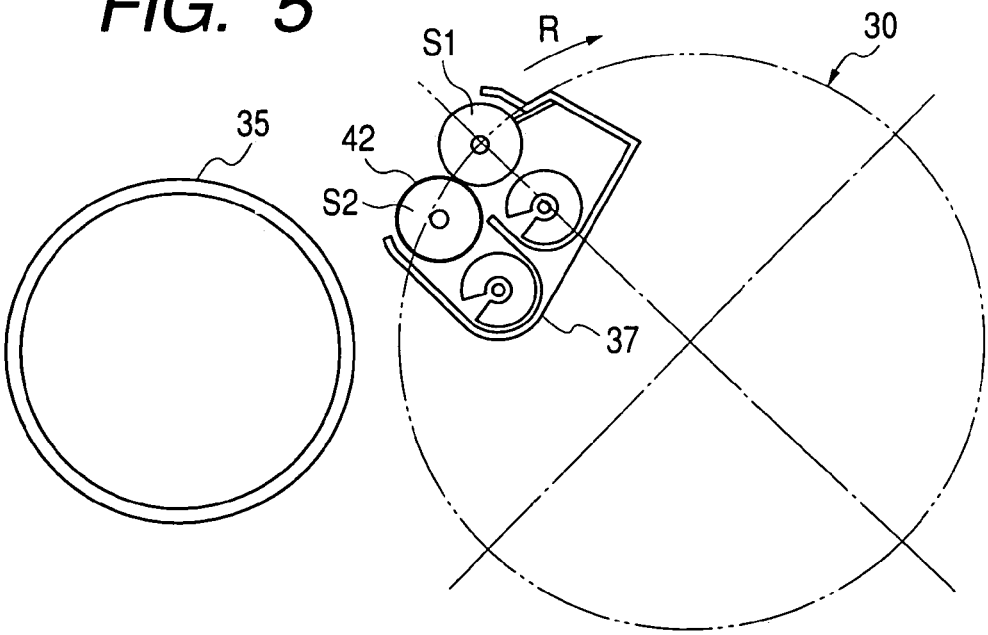
FIG. 5 is a cross-sectional view illustrating the developing operation of the developing apparatus according to the present invention.

After the termination of the developing, the developing device 37 or the developing sleeve is rotated (retracted) to a position in which the developing sleeve S2 does not interfere with the photosensitive drum 35 even if the rotary type developing apparatus 30 is rotated, whereafter the rotary type developing apparatus 30 is rotated (see FIG. 5).

The timing at which the movement of the developing sleeve S2 to the developing position is started may be before the rotation of the rotary type developing apparatus 30 is stopped, and by doing so, the changeover time can be made shorter than that by rotating the developing device 37 after the rotary type developing apparatus 30 is stopped.

Thus, according to the present embodiment, design is made such that after the predetermined developing has been effected by the use of the developing sleeve S2, the developing device 37 or the developing sleeve S2 is rotated (retracted) to the position in which the developing sleeve S2 does not interfere with the photosensitive drum 35 and therefore, the plurality of developing sleeves S1 and S2 of each developing device 37 can be disposed in proximity to the photosensitive drum 35.

Also, design is made such that the developing sleeve S1 is positioned by the developing device 37 so as to form the predetermined gap (SD gap) "a" between it and the photosensitive drum 35, and the developing device 37 is rotated to thereby bring the position-regulatable regulating member 42 provided on the developing sleeve S2 into contact with the photosensitive drum 35 and form the predetermined gap (SD gap) "b" between the developing sleeve S2 and the photosensitive drum 35 and therefore, the gaps (SD gaps) "a" and "b" between the photosensitive drum 35 and the developing sleeves S1, S2 can be positioned highly accurately.

While in the foregoing, description has been made of a case where developing is effected by the developing sleeve S1, whereafter developing is effected by the developing sleeve S2, the developing by the developing sleeve S1 and the developing by the developing sleeve S2 may be started at a time after the developing sleeves S1 and S2 have been stopped at the developing position. Also, design may be made such that a mode in which the rotation of the developing sleeve S2 is selectively controlled and developing is effected by the developing sleeve S1 alone, and a mode in which developing is effected by the use of both of the developing sleeves S1 and S2 are set to thereby set a high image quality mode, a standard image quality mode, a high speed output mode, etc. so as to enable a user to select the modes with the quality of image, the output time, etc. taken into account.

Description will now be made of a modification according to the present invention, i.e., not the construction in which the regulating member of the developing sleeve as described above is directly abutted against the photosensitive drum, but an example in which the regulating member is indirectly abutted against the photosensitive drum to thereby ensure the distance between the photosensitive drum surface (image forming area) and the developing sleeve surface (image forming area).

Figure 6:
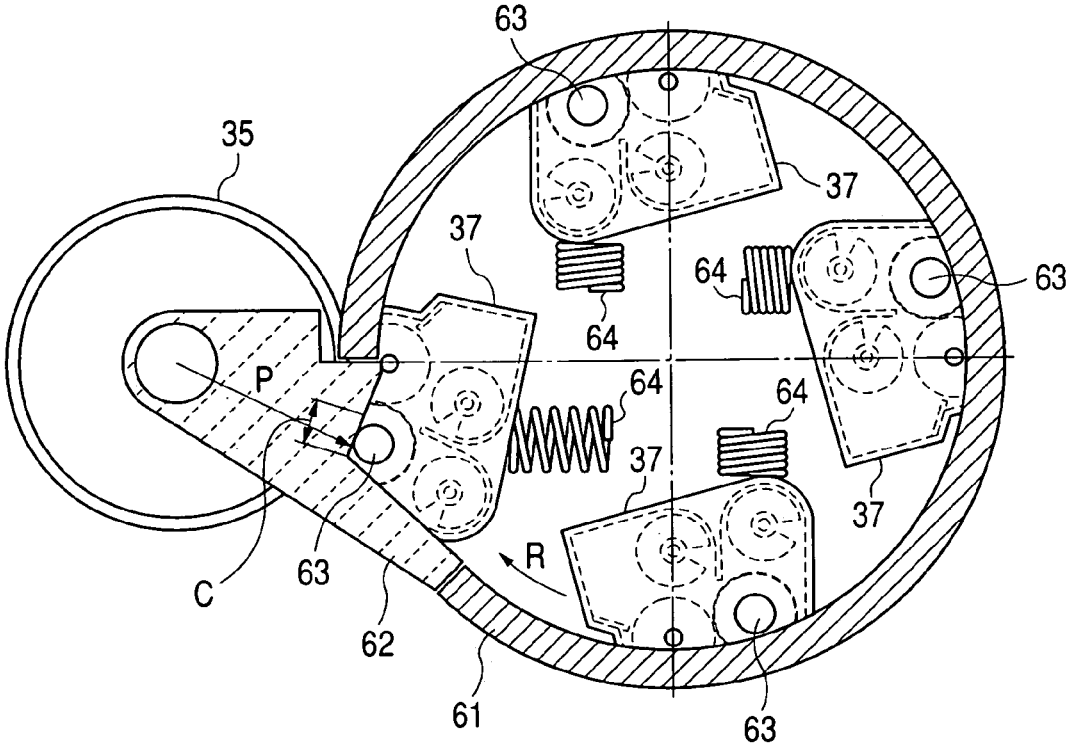
FIG. 6 is a cross-sectional view of the developing device positioning mechanism of the developing apparatus according to the present invention.

FIG. 6 is a cross-sectional view of a positioning mechanism for the developing device (the developing sleeve S2 on the downstream side) 37.

The positioning of the developing device 37 is done by pressing the developing device 37 against a developing device rotating rail 61 and a developing position determining rail 62 by means of a pressure spring 64, and abutting a runner 63 against the rail 62.

The developing device rotating rail 61 is for determining the position of the developing device 37 when not used, and holds the runner 63 of the developing device 37 in its retracted position so that during the rotation of the rotary type developing apparatus 30, the developing sleeve S2 may not interfere with the photosensitive drum 35.

Also, the developing position determining rail 62 is a member for guiding the developing sleeve S2 on the downstream side to the developing position as the developing device 37 approaches the developing position, and when the developing sleeve S1 on the upstream side leaves the developing position, the rail 62 contains the developing device 37 in the rotary type developing apparatus 30 so that the developing sleeve S2 on the downstream side may not interfere with the photosensitive drum 35. The developing position determining rail 62 is mounted on the rotary shaft of the photosensitive drum 35, and the gap (hereinafter referred to as the SD gap) between the developing sleeve S2 on the downstream side and the photosensitive drum 35 is accurately positioned by a portion. The developing position determining rail 62, if its accuracy can be ensured, need not be mounted on the rotary shaft of the photosensitive drum 35, and the developing position determining rail 62 may be adjusted so that a desired SD gap may be obtained.

The developing position determining rail 62 has a portion having a curvature of a radius P about the center of the photosensitive drum 35 within a range C which determines the SD gap of the developing sleeve S2 on the downstream side, whereby even if the stopped position of the rotary type developing apparatus 30 deviates, the SD gap of the developing sleeve S2 on the downstream side can be ensured.

Also, as previously described, the developing device rotating rail 61 retracts the developing device 37 by a minimum amount for which the developing sleeve S2 does not interfere with the photosensitive drum 35, but it may be designed to further retract the developing device 37 and suppress the moment of inertia of the rotary type developing apparatus 30 to a small value to thereby reduce the load of the driving motor of the rotary type developing apparatus 30.

As is apparent from the foregoing description, according to the present embodiment, both of the higher speed (higher quality of image) of image forming and the downsizing of the image forming apparatus can be made compatible. In addition, the developer carrying member can be positioned highly accurately with a predetermined gap with respect to the image bearing member.

What is claimed is:

1. An image forming apparatus comprising:

a plurality of developing devices for developing an electrostatic image formed on an image bearing member; and a rotary member holding said plurality of developing devices for selectively moving any one of said developing devices to a developing position, wherein each of said plurality of developing devices has a first developer carrying member and a second developer carrying member for developing the electrostatic image with developers carried thereby, respectively, wherein each of said plurality of developing devices is held by said rotary member so as to be relatively rockable with respect to said rotary member, wherein when the one of said developing devices is in the developing position, said first developer carrying member and said second developer carrying member of one of said developing devices are positioned in predetermined positions with respect to the image bearing member, respectively, wherein each of said plurality of developing devices has an abutting member for abutting against a guide portion provided on an apparatus main body to ensure a distance between said second developer carrying member and the image bearing member, wherein each of said plurality of developing devices is rockable about a rocking center centered on a rotation center of said first developer carrying member, and wherein when the one of said developing devices is in the developing position, said first developer carrying member is disposed in the one of said developing devices so that said first developer carrying member is opposed to the image bearing member with a predetermined distance between said first developer carrying member and the image bearing member, and said abutting member abuts against said guide portion.

2. An image forming apparatus according to claim 1, wherein said guide portion has a curvature shape centered on a rotation center of the image bearing member.

3. An image forming apparatus comprising:

a plurality of developing devices for developing an electrostatic image formed on an image bearing member; and a rotary member holding said plurality of developing devices for selectively moving any one of said developing devices to a developing position, wherein each of said plurality of developing devices comprises a first developer carrying member and a second developer carrying member for developing the electrostatic image with developers carried thereby, respectively, and an abutting member provided on said second developer carrying member for abutting against the image bearing member to ensure a distance between said second developer carrying member and the image bearing member, wherein said second developer carrying member is relatively movable with respect to said rotary member so as to have said abutting member abut against the image bearing member prior to a developing operation, and wherein said image forming apparatus is operable in a first mode in which the developing operation is performed by the use of said first developer carrying member alone without said abutting member abutting against the image bearing member, and a second mode in which the developing operation is performed by the use of both of said first developer carrying member and said second developer carrying member with said abutting member abutting against the image bearing member.

4. An image forming apparatus according to claim 1, wherein when the one of said plurality of developing devices is in the developing position, said first developer carrying member is disposed in the one of said plurality of developing devices so that said first developer carrying member is opposed to the image bearing member with a predetermined distance between said first developer carrying member and the image bearing member.

* * * * *